US011957190B2

(12) United States Patent
Johnson

(10) Patent No.: US 11,957,190 B2
(45) Date of Patent: Apr. 16, 2024

(54) SPORTS GARMENT FOR TEAM SPORTS

(71) Applicant: PUMA SE, Herzogenaurach (DE)

(72) Inventor: Charles Johnson, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 549 days.

(21) Appl. No.: 17/047,670

(22) PCT Filed: Jun. 15, 2018

(86) PCT No.: PCT/EP2018/065942
§ 371 (c)(1),
(2) Date: Oct. 14, 2020

(87) PCT Pub. No.: WO2019/238240
PCT Pub. Date: Dec. 19, 2019

(65) Prior Publication Data
US 2021/0030082 A1 Feb. 4, 2021

(51) Int. Cl.
*A41D 13/00* (2006.01)

(52) U.S. Cl.
CPC ..... *A41D 13/0015* (2013.01); *A41D 2400/38* (2013.01); *A41D 2500/10* (2013.01)

(58) Field of Classification Search
CPC ..... A41D 2500/10; A41D 2400/38; A41D 13/0015
See application file for complete search history.

(56) References Cited

U.S. PATENT DOCUMENTS 5,131,100 A * 7/1992 Atwater ..... D04B 21/207 2/403
5,210,877 A 5/1993 Newman
(Continued)

FOREIGN PATENT DOCUMENTS

CN 106360838 A 2/2017
DE 102016107164 A1 10/2017
(Continued)

OTHER PUBLICATIONS

International Search Report of International Application No. PCT/EP2018/065942, dated Feb. 27, 2019, 4 pages.
(Continued)

*Primary Examiner* — Richale L Quinn
(74) *Attorney, Agent, or Firm* — Quarles & Brady LLP

(57) ABSTRACT

The invention relates to sports garment (1) for team sports, especially for soccer, football, rugby, handball or basketball, comprising an upper part (2) which covers at least a part of the torso of the wearer and pants (3) which covers at least a part of the abdomen of the wearer, wherein the upper part (2) and the pants (3) are forming a one-piece part. To improve the fit of the sports garment at the body of the wearer and to ensure a high degree of convenience during wearing the invention proposes that the upper part (2) and the pants (3) are made as a unitary knitted design, wherein the garment (1) is made as a seamless textile article without seams around the whole circumference of the garment (1) along at least 40% (h) of the total vertical extension (H) of the garment (1), wherein the seamless section of the garment (1) extends at least along a part of the vertical extension of the upper part (2) and extends at least along a part of the vertical extension of the pants (3).

20 Claims, 2 Drawing Sheets

(56) References Cited

U.S. PATENT DOCUMENTS 5,343,564 A * 9/1994 Reynolds ..... A41D 13/001 2/70
D378,317 S 3/1997 Wike
D400,338 S * 11/1998 Maves ..... D2/742
5,994,612 A * 11/1999 Watkins ..... A41D 31/12 602/41
6,047,406 A * 4/2000 Dicker ..... A63B 21/4025 2/69
D518,624 S * 4/2006 Zimmerman ..... D2/742
D520,715 S * 5/2006 Ota ..... A41D 13/08 D2/731
7,074,499 B2 * 7/2006 Schnurer ..... D01F 1/106 428/397
D629,998 S * 1/2011 Lambertz ..... D2/704
D641,134 S 7/2011 Zarabi
D654,660 S * 2/2012 Jones ..... D2/717
D655,479 S * 3/2012 Umbach ..... D2/720
D663,102 S * 7/2012 Hogg ..... D2/738
D663,924 S * 7/2012 Mullen ..... D2/718
D678,660 S * 3/2013 Fryer ..... D2/712
D679,891 S * 4/2013 Vick ..... D2/743
8,548,622 B2 * 10/2013 Berns ..... A41D 13/0015 700/130
D730,583 S * 5/2015 Read ..... D29/100
RE46,331 E * 3/2017 Savage ..... D2/742
D783,943 S * 4/2017 Adrovic ..... D2/756
D790,161 S * 6/2017 Lee ..... D2/742
9,687,031 B2 * 6/2017 Turner ..... A41D 13/0015
D794,909 S * 8/2017 Lomax ..... D2/731
D804,781 S * 12/2017 Kositchiranant ..... D2/731
D827,983 S * 9/2018 Mong ..... D2/742
D839,543 S * 2/2019 Miller ..... D2/742
D848,115 S * 5/2019 Brown ..... D2/731
D872,972 S * 1/2020 Caron ..... D2/742
10,548,358 B2 * 2/2020 Roberts ..... A41D 27/24
D885,709 S * 6/2020 Jin ..... D2/702
10,779,586 B2 * 9/2020 Langer ..... A41D 31/18
11,213,082 B1 * 1/2022 Yang ..... A41D 1/08
11,357,271 B2 * 6/2022 Mason ..... A61F 13/148
11,382,372 B2 * 7/2022 Navarro ..... A41D 31/04
11,445,774 B2 * 9/2022 Johnson ..... A41D 31/0005
11,478,920 B2 * 10/2022 Witherspoon ..... A61B 5/7267
2005/0229293 A1 * 10/2005 Miller ..... A41D 1/089 2/403
2006/0230488 A1 10/2006 Rudolph
2007/0050879 A1 3/2007 Etzold et al.
2010/0130903 A1 * 5/2010 Rock ..... D04B 1/243 602/62
2011/0107502 A1 * 5/2011 Dalhausser ..... A61F 13/08 2/456
2011/0138524 A1 * 6/2011 Alfstad ..... A41D 13/015 2/24
2011/0302686 A1 * 12/2011 Chapuis ..... A41D 13/0015 2/242
2012/0260400 A1 * 10/2012 Franz ..... A41D 27/04 2/236
2015/0257454 A1 * 9/2015 Johnson ..... A41C 1/02 450/11
2016/0007662 A1 * 1/2016 Powell ..... A41D 1/089 2/228
2016/0095367 A1 * 4/2016 Curran ..... A41D 27/285 2/243.1
2016/0295933 A1 * 10/2016 Herbener ..... A41D 27/20
2016/0302495 A1 * 10/2016 Smart ..... A41D 13/0015
2017/0280792 A1 * 10/2017 Spenser ..... A41D 27/18
2017/0295859 A1 * 10/2017 Butler ..... A41D 31/02
2017/0318868 A1 * 11/2017 Luong ..... A41D 1/08
2018/0206567 A1 * 7/2018 Diakonov ..... A41D 27/207
2018/0228232 A1 * 8/2018 Fisher ..... A41F 9/025
2018/0279699 A1 * 10/2018 Olmos Plaza ..... A41D 15/002
2018/0295900 A1 * 10/2018 Murphy ..... A41D 1/08
2018/0325188 A1 * 11/2018 Burhance ..... A41F 9/00
2019/0015283 A1 * 1/2019 Jackson ..... A61H 1/008
2019/0045856 A1 * 2/2019 Musciacchio ..... A41D 7/00
2019/0134454 A1 * 5/2019 Mahoney ..... A63F 13/24
2019/0150540 A1 * 5/2019 Otashevich ..... A41D 1/06
2019/0159530 A1 * 5/2019 Shapiro ..... A41D 13/002
2019/0160652 A1 * 5/2019 Mahoney ..... A61F 2/68
2019/0166797 A1 * 6/2019 Lubets ..... A41D 13/0015
2019/0373969 A1 * 12/2019 Bolker ..... A41D 1/089
2020/0107590 A1 * 4/2020 Berger ..... A41D 7/005
2020/0120999 A1 * 4/2020 Mason ..... A41C 1/02
2020/0360754 A1 * 11/2020 Kehler ..... A63B 21/00178
2021/0030082 A1 * 2/2021 Johnson ..... A41D 13/0015
2021/0037902 A1 * 2/2021 Johnson ..... A41D 13/0015
2021/0047757 A1 * 2/2021 Cleveland ..... A41D 17/02
2021/0059321 A1 * 3/2021 Giorgini ..... A41D 1/04
2021/0059333 A1 * 3/2021 Giorgini ..... D04B 1/24
2021/0059864 A1 * 3/2021 Reilly ..... A61F 13/08
2021/0172101 A1 * 6/2021 Jayasundara ..... A41D 19/00
2021/0186132 A1 * 6/2021 Solano ..... A41C 1/08
2021/0235786 A1 * 8/2021 Shultz ..... A61F 5/02
2021/0251312 A1 * 8/2021 Vitarana ..... A41D 31/12
2021/0267284 A1 * 9/2021 Wong ..... A41D 31/18
2022/0015466 A1 * 1/2022 Miles ..... A43B 5/06
2022/0295909 A1 * 9/2022 Melendez ..... A41C 3/0028

FOREIGN PATENT DOCUMENTS

EP 3170930 A1 5/2017
GB 201614916 10/2016
JP 2004263362 A 9/2004
JP 2011021291 A 2/2011
JP 2013189743 A 9/2013
JP 2015206146 A 11/2015
KR 20100092362 A 8/2010
WO 2008063259 A1 5/2008
WO 2015/162945 A1 10/2015
WO 2016173031 A1 11/2016

OTHER PUBLICATIONS

Written Opinion of International Application No. PCT/EP2018/065942, dated Feb. 27, 2019, 6 pages.

International Preliminary Report on Patentability (Form IPEA/409) of International Application No. PCT/EP2018/065942, dated Apr. 29, 2020, 20 pages.

First Office Action from corresponding Japanese Patent Application No. 2020-545247 dated Oct. 19, 2021 (8 pages) including English translation.

Definition of "portion" accessed via thefreedictionary.com. American Heritage® Dictionary of the English Language, Fifth Edition. (2011). Retrieved Jul. 8, 2021. https://www.thefreedictionary.com/portion. (Year: 2011).

* cited by examiner

SPORTS GARMENT FOR TEAM SPORTS

This application is a U.S. National Stage application, filed pursuant to 35 U.S.C. § 371, of international application no. PCT/EP2018/065942, filed on Jun. 15, 2018, the contents of which is incorporated herein by reference in its entirety.

The invention relates to sports garment for team sports, especially for soccer, football, rugby, handball or basketball, comprising an upper part which covers at least a part of the torso of the wearer and pants which covers at least a part of the abdomen of the wearer, wherein the upper part and the pants are forming a one-piece part.

A sports garment of the kind mentioned above is known from WO 2005/039337 A1. This one-piece garment allows a better fit during use and makes it more difficult for other players of the team sports to grab and hold the garment. It was found that the convenience during wearing of the garment should still be improved.

Thus, it is an object of the present invention to propose a garment of the kind mentioned above which allows a better fit of the sports garment at the body of the wearer and also to ensure a high degree of convenience during wearing.

The solution of this object according to the invention is characterized in that the upper part and the pants are made as a unitary knitted design, wherein the garment is made as a seamless textile article without seams around the whole circumference of the garment along at least 40% of the total vertical extension of the garment, wherein the seamless section of the garment extends at least along a part of the vertical extension of the upper part and at least along a part of the vertical extension of the pants.

Preferably the garment is made as a seamless textile article around the whole circumference of the same along at least 50% of the total vertical extension.

Vertical extension means the extension of the garment when it is worn by a player which stands upright on the ground. Accordingly, at least 40%, preferably 50%, of the vertical extension of the garment is free of any seams so that the convenience during wearing is improved and also the fit of the garment is optimized.

Thus, the mentioned seamless design along at least 40%, preferably 50%, of said extension means that the garment has in this region basically a seamless tubular shape without any disturbances which encompasses the body of the wearer.

The garment preferably is made by means of a circular knit process or a warp knit process. Those knitting processes are known as such in the art so that it is not necessary to explain the same here in detail.

Two arm sleeves can be connected with the base part of the upper part, wherein the arm sleeves are fixed to the base part of the upper part by means of two sleeve seams.

Furthermore, an inner leg seam can be provided at the inner side of the pant legs of the pants, wherein the remainder of the pants are free from any seam.

The mentioned leg seam runs thus in a centre plane of the garment between the two adjacent pant legs.

One or two zippers can be arranged in the top region of the upper part and/or in the side region of the upper part to facilitate pulling on and taking off of the garment.

A preferred embodiment proposes that the garment comprises at least one first region in which the knitted material has a defined first stretch resistance and that the garment comprises at least one second region in which the knitted material has a defined second stretch resistance, which is different from the first stretch resistance. That is, the stretch resistance is not homogeneous along the whole surface of the garment but different in specific sections.

The second stretch resistance is preferably below 85% of the first stretch resistance, specifically preferred below 70% of the first stretch resistance. The stretch resistance is here defined by the quotient of a tension force (in N) and the obtained elongation (in mm), i. e. in N/mm, measured by using a test strip with defined geometry (length and width) cut out of the knitted material in the first and second region. A test force is applied on this test strip and the elongation is measured to determine the stretch resistance accordingly.

For creating different stretch resistances different methods can be applied. One possibility is that the first and second regions of the garment differ in the number of knitted loops per centimeter of extension. Thus, the region with the higher stretch resistance can be provided with more knitted loops as the region with the lower stretch resistance. Another possibility is that the knitted fabric is made of at least two different yarns, wherein the stretchability of the at least two yarns is different, wherein the ratio of used yarns differs in the first and second regions of the garment. So, to get a higher stretch resistance a yarn can be employed which has a lower stretchability; to get a lower stretch resistance a yarn can be used which has a higher stretchability. By using the right ratio between the two yarns the total stretch resistance of a region of the garment can be adjusted to a desired value.

The first region is preferably a section of the garment which covers the diaphragm of the wearer, wherein the second region is a section of the garment covering the chest of the wearer and/or a section of the garment covering the belly button of the wearer. In this case it is preferred that the second region has a semi-lunar shape seen perpendicular to the surface of the garment.

Furthermore, the first region can be a section of the garment covering the diaphragm of the wearer, wherein the second region is a section of the garment covering the upper back of the wearer and/or the back side of the transition zone between the upper part and the pants. In this case it is preferred that the second region has an O-shape or H-shape seen perpendicular to the surface of the garment.

A further embodiment of the invention provides that additional pants are arranged at the sport garment. Those pants can be sewn on the knitted garment. The arrangement of the additional pants is made in such a manner that the knitted structure of the sports garment is not influenced. The additional pants can be designed as a front and a back panel which are fixed at the sports garment in the lateral regions of the same. Specifically, the additional pants can be made of woven or knitted material.

Of course the sports garment can also be equipped with a respective fly for easy use. The fly can have a knitted structure.

By using specifically the above mentioned circular or warp knitting methods it becomes quite easy to adjust the stretch resistance according to a predetermined distribution along the surface of the garment in a very economical manner, i. e. by a respective programming of the knitting machine.

The seamless circular knitting process is as specifically preferred method to obtain a body fit on the torso area (upper part of the garment) and a slim fit in the bottom area (pant of the garment).

The seamless circular knitting process can also be employed to obtain a slim fit for the whole garment (upper part and pant of the garment).

Seamless warp knitting is specifically used for a body fit for the whole garment (upper part and pant of the garment).

The proposed sports garment thus uses seamless circular knitting or seamless warp knitting, which combines the jersey (upper part of the garment) and the short (pant) of a team sport uniform.

Preferably it features differentiated stretch areas placed according to specific body mapped criteria with the aim to provide with an optimized freedom of movement. In areas where more movement is expected, the fabric will feature higher stretch, therefore restricting less the movement of the player. In areas where less movement is expected, the fabric will feature lower stretch, therefore providing higher support to certain muscles.

In the drawings an embodiment of the invention is shown.

Figure 2:
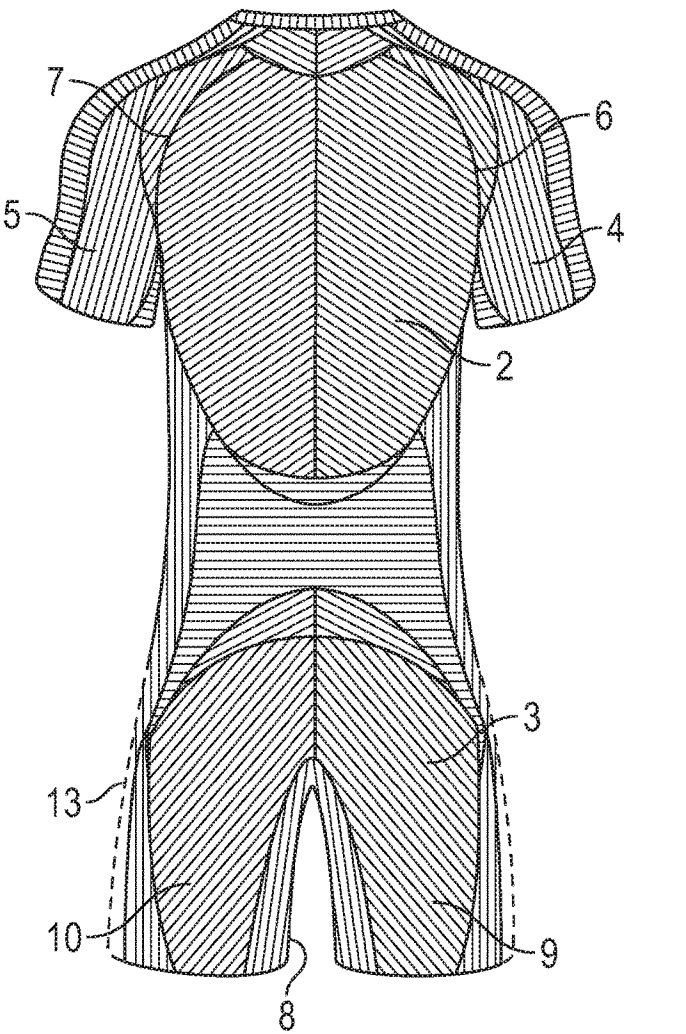
FIG. 2 shows the corresponding reverse side of the sports garment.
Figure 1:
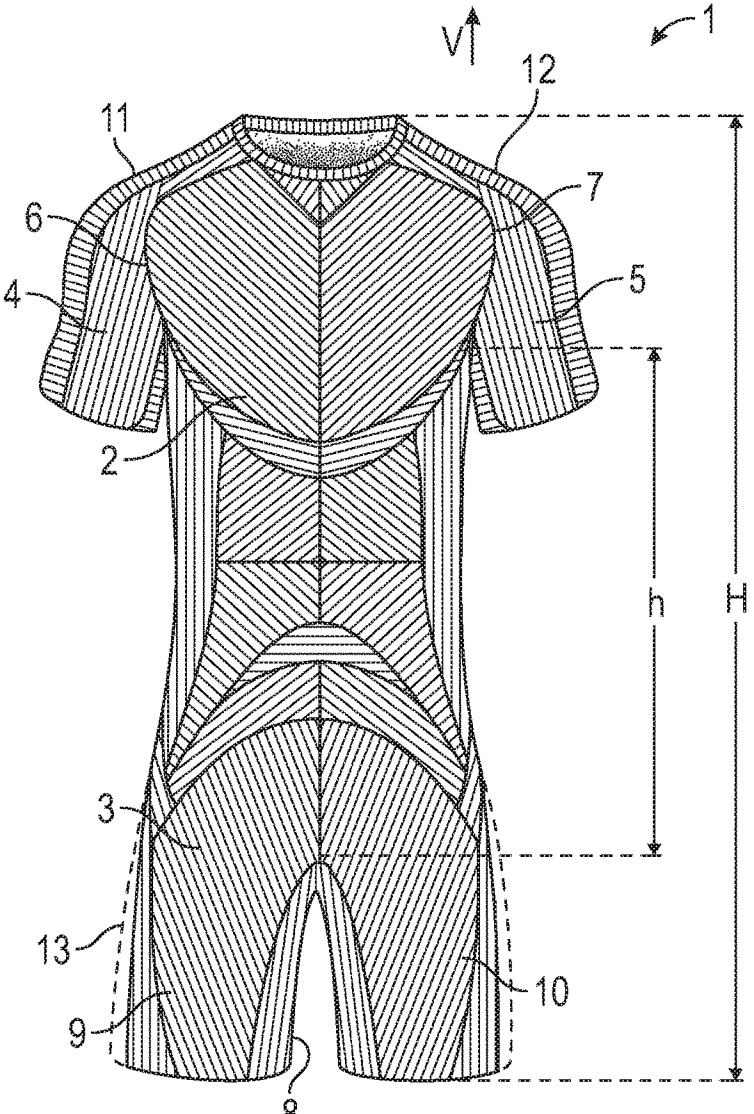
FIG. 1 shows a front side of a sports garment.

In FIG. 1 the front side of a sports garment 1 is shown, FIG. 2 shows the reverse side of the same. In the present embodiment the garment is a soccer suit. It has an upper part 2 which covers the torso of the wearer (not shown) of the garment 1 and pants 3 which cover partially the abdomen of the wearer. The upper part 2 and the pants 3 are made as a one-piece element, i. e. the whole garment 1 is only one piece which covers during intended use the torso as well as the abdomen of the wearer.

As can be seen from FIG. 1 the garment 1 has a total vertical extension H (see vertical direction V). This direction has to be understood in that manner that the garment 1 is worn by a wearer who stands upright on the ground.

The upper part 2 and the pants 3 are made as a unitary knitted design, i. e. the shown fabric (excluded the arm sleeves 4, 5) is produced on a knitting machine as a unitary part substantially without seams. More specifically, the garment 1 is made as a seamless textile article without seams around the whole circumference of the garment 1 along at least 40% of the total vertical extension H of the garment. The seamless extension is denoted with h (below the sleeve seams 6, 7; above the inner leg seam 8). The seamless section of the garment 1 extends along a part of the vertical extension of the upper part 2 as well as along a part of the vertical extension of the pants 3 as can be seen from FIG. 1.

The only seams of the garment 1 are sleeve seams 6 and 7 by which the arm sleeves 4 and 5 are connected to the base part of the garment 1; furthermore, an inner leg seam 8 is arranged to form the two pant legs 9 and 10 from the knitted fabric.

Zippers 11 and 12 in the upper region of the upper part 2 allow an easy pulling on and taking off of the garment 1.

Figure 4:
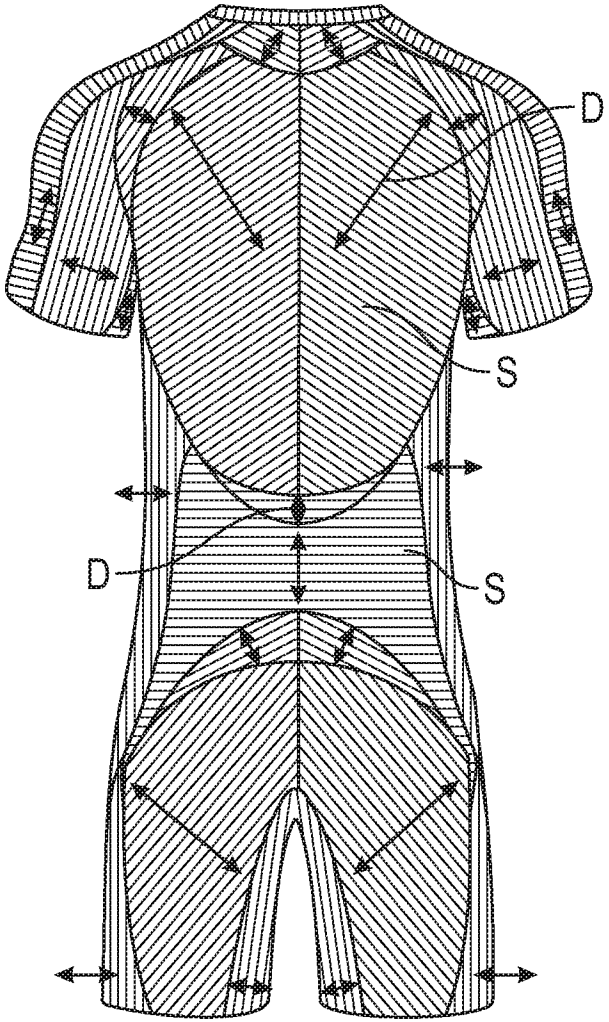
FIG. 3 shows the front side of the sports garment with denotation of areas of different stretchability and FIG. 4 shows the reverse side of the sports garment with denotation of areas of different stretchability.
Figure 3:
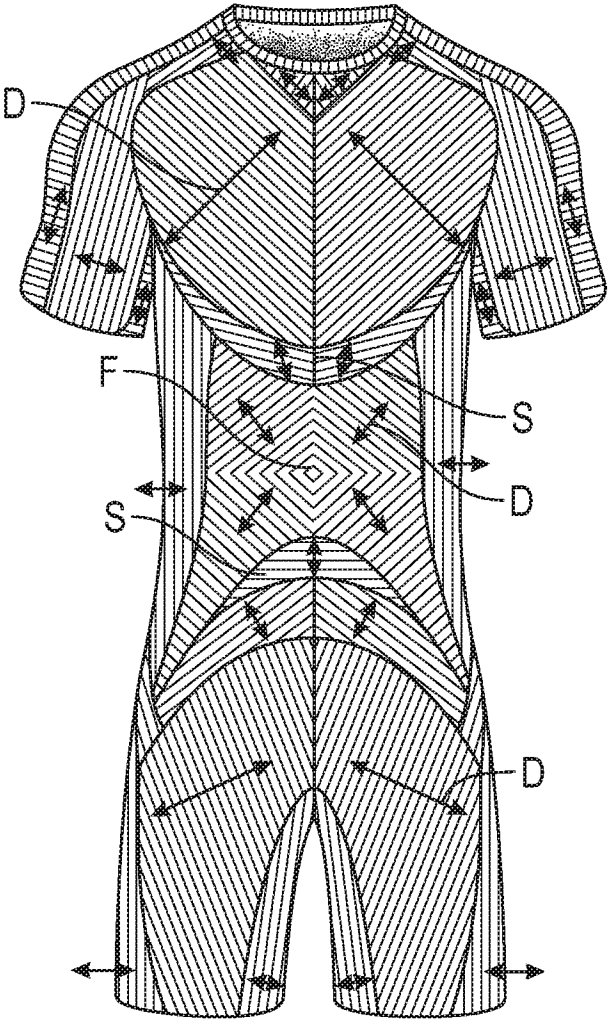

The lines in FIGS. 1 and 2 (besides the seams 6, 7 and 8) are no seams but denote distinct sections of the garment with special properties as explained now with regard to FIGS. 3 and 4.

In FIGS. 3 and 4 the direction of stretch D is denoted by double-arrows for different sections of the garment 1 which stretch occurs during intended use of the garment 1. As can be seen the different regions of the garment are exposed to different directions of stretch during intended use of the garment 1.

Thereby, the ability to stretch of certain regions of the garment 1 is significantly different compared with other regions. Accordingly, the present concept allows to knit certain sections of the garment 1 in different manner to influence the stretch resistance of the knitted fabric.

First regions F and second regions S are denoted in FIGS. 3 and 4 which mark regions with a high stretch resistance (first region F, denoted only in FIG. 3) and with a reduced lower stretch resistance (second regions S).

In FIG. 3 it can be seen that the first region F is a section of the garment 1 which covers the diaphragm of the wearer. Here, no significant stretch occurs during intended use of the garment 1. This first region F is a reference region for the stretch resistance for comparing the stretch resistance in relation to the second regions S.

A second region S of the garment 1 with a reduced stretch resistance covers the chest (see upper denotation S in FIG. 3) which is—due to the reduced stretch resistance—thus more elastic when a tensile force is applied. The same applies for the second region S (see lower denotation S in FIG. 3) which relates to a section of the garment 1 which covers the belly button of the wearer. Both second regions S in FIG. 3 have a semi-lunar shape.

With regards to the reverse side of the garment basically the same applies: Here, the reference is again the first region F (see FIG. 3) which covers the diaphragm of the wearer, wherein now the second region S is a section of the garment 1 covering the upper back of the wearer (see upper denotation S in FIG. 4) and the transition zone between the upper part 2 and the pants 3 (see lower denotation S in FIG. 4). In the present embodiment the upper second region S has substantially the shape of an "O", while the lower second region S has substantially the shape of an "H".

Using the preferred circular or warp knitting process it is quite easy to machine different regions of the fabric with different stretch resistances. Different possibilities for doing so are described above.

Accordingly, the garment 1 can easily be adapted to match with specific requirements of the wearer with respect to the stretch behaviour of the garment during intended use.

Also additional pants 13 can be arranged at the sports garment 1. In FIGS. 1 and 2 those additional pants are depicted only schematically by the dotted lines. Those additional pants 13 need not necessarily have a technical function; they can also be provided (only) due to optical reasons.

REFERENCE NUMERALS

1 Sports garment
2 Upper part of the garment
3 Pants of the garment
4 Arm sleeve
5 Arm sleeve
6 Sleeve seam
7 Sleeve seam
8 Inner leg seam
9 Pant leg
10 Pant leg
11 Zipper
12 Zipper
13 Additional pant
H Total vertical extension of the garment
h Extension of the seamless section of the garment
V Vertical direction
D Direction of stretch
F First region

The invention claimed is:

1. A sports garment, comprising an upper part for covering at least a part of a torso of a wearer and pants for covering at least a part of an abdomen and legs of the wearer, the pants including legs, wherein the upper part and the pants form a one-piece part, wherein the upper part and the pants are made as a unitary knitted design with a knitted material, wherein the garment includes a seamless section that is a seamless textile article without seams around a whole circumference of the garment along at least 40% of a total vertical extension of the garment, wherein the seamless section of the garment extends at least along a part of the vertical extension of the upper part and extends at least along a part of the vertical extension of the pants, wherein the garment comprises at least one first region in which the knitted material has a defined first stretch resistance and that the garment comprises at least one second region in which the knitted material has a defined second stretch resistance that is below 85% of the first stretch resistance, wherein the first region is a section of the garment for covering a diaphragm of the wearer, and wherein the second region is a section of the garment having an O-shape and/or H-shape for covering an upper back of the wearer and/or a back side of a transition zone between the upper part and the pants, and wherein the first knitted region comprises a greater number of knitted loops per centimeter of extension than the second knitted region.

2. The sports garment according to claim 1, wherein the garment is made as a seamless textile article around the whole circumference of the garment along at least 50% of the total vertical extension of the garment.

3. The sports garment according to claim 1, wherein the garment is made by means of a circular knit process.

4. The sports garment according to claim 1, wherein the garment is made by means of a warp knit process.

5. The sports garment according to claim 1, wherein two arm sleeves are connected with a base part of the upper part, wherein each of the two arm sleeves are fixed to the base part of the upper part at a seam.

6. The sports garment according to claim 1, wherein an inner leg seam is provided at an inner side of the pant legs of the pants, wherein a remainder of the pants is free from any seam.

7. The sports garment according to claim 6, wherein the inner leg seam runs in a centre plane of the garment.

8. The sports garment according to claim 1, wherein one or more zippers are arranged in a top region of the upper part and/or in a side region of the upper part.

9. The sports garment according to claim 1, wherein the knitted material is made of at least two different yarns, wherein a stretchability of the at least two yarns is different, and wherein a ratio of used yarns differs in the first and second regions of the garment.

10. The sports garment according to claim 1, further including additional pants configured to be arranged on the sports garment.

11. The sports garment according to claim 10, wherein the additional pants are sewn on the sports garment.

12. The sports garment according to claim 10, wherein the second region further covers a belly button of the wearer.

13. The sports garment according to claim 1, wherein the first region includes a first knit construction, and the second region includes a second knit construction that is different from the first knit construction.

14. The sports garment according to claim 1, wherein the second region further covers a chest of the wearer.

15. The sports garment according to claim 1, wherein the second stretch resistance is below 70% of the first stretch resistance.

16. A sports garment, comprising:

an upper part and pants that are made as a unitary knitted component with a knitted material, the upper part being configured for covering at least a portion of a torso of a wearer, and the pants being configured for covering at least a portion of legs of the wearer, wherein the upper part and the pants form a one-piece part having a seamless section along at least 50% of a total vertical extension of the garment, the knitted material in the seamless section being without seams around an entire circumference of the garment, wherein the knitted material comprises a first knitted region and a second knitted region, the first knitted region comprising a first knit construction that is different from a second knit construction of the second knitted region, wherein the knitted material of the first knitted region has a defined first stretch resistance and the knitted material of the second knitted region has a defined second stretch resistance that is below 85% of the first stretch resistance, wherein the first knitted region is configured to stretch in a direction different from a direction of stretch of the second knitted region, and wherein the first knitted region comprises a greater number of knitted loops per centimeter of extension than the second knitted region.

17. The sports garment according to claim 16, wherein the first knitted region is configured for covering a diaphragm of the wearer, and wherein the second knitted region is configured for covering a chest of the wearer.

18. The sports garment according to claim 17, wherein the first knitted region exhibits a higher stretch resistance than the second knitted region.

19. The sports garment according to claim 16, wherein the first knitted region is made of a first yarn, and the second knitted region is made of a second yarn, the first yarn having a greater stretchability than the second yarn.

20. The sports garment according to claim 16, wherein a portion of the second region has an O-shape, an H-shape, or a semi-lunar shape.

* * * * *